US009463953B2

(12) United States Patent
Lee et al.

(10) Patent No.: US 9,463,953 B2
(45) Date of Patent: Oct. 11, 2016

(54) CONTROL SYSTEM AND METHOD FOR ELEVATOR

(71) Applicant: Shenzhen Airdrawing Technology Service Co., Ltd., Shenzhen (CN)

(72) Inventors: Hou-Hsien Lee, New Taipei (TW); Chang-Jung Lee, New Taipei (TW); Chih-Ping Lo, New Taipei (TW)

(73) Assignee: Shenzhen Airdrawing Technology Service Co., Ltd, Shenzhen (CN)

( * ) Notice: Subject to any disclaimer, the term of this patent is extended or adjusted under 35 U.S.C. 154(b) by 261 days.

(21) Appl. No.: 14/333,658

(22) Filed: Jul. 17, 2014

(65) Prior Publication Data

US 2015/0021123 A1 Jan. 22, 2015

(30) Foreign Application Priority Data

Jul. 17, 2013 (TW) ..... 102125641 A

(51) Int. Cl.
*B66B 1/34* (2006.01)

(52) U.S. Cl.
CPC ..... *B66B 1/3476* (2013.01); *B66B 2201/211* (2013.01)

(58) Field of Classification Search
CPC .. B66B 1/34; B66B 1/3476; B66B 2201/211
USPC ..... 187/247, 281, 286, 380–389, 391–393
See application file for complete search history.

(56) References Cited

U.S. PATENT DOCUMENTS

| | | | | |
|---|---|---|---|---|
| 4,555,724 | A * | 11/1985 | Enriquez | B66B 1/3476 187/392 |
| 5,258,586 | A * | 11/1993 | Suzuki | B66B 1/2458 187/380 |
| 7,588,126 | B2 * | 9/2009 | Siikonen | B66B 5/022 187/313 |
| 7,637,354 | B2 * | 12/2009 | Kawai | B66B 5/024 187/313 |
| 8,020,672 | B2 * | 9/2011 | Lin | B66B 1/34 187/316 |
| 8,196,711 | B2 * | 6/2012 | Tokura | B66B 1/2458 187/382 |
| 8,678,142 | B2 * | 3/2014 | Takeuchi | B66B 1/468 187/247 |
| 2009/0223749 | A1 * | 9/2009 | Amano | B66B 5/0012 187/392 |
| 2013/0233653 | A1 * | 9/2013 | Chen | B66B 1/3476 187/381 |
| 2015/0068850 | A1 * | 3/2015 | Mattsson | B66B 1/3476 187/392 |

* cited by examiner

*Primary Examiner* — Anthony Salata
(74) *Attorney, Agent, or Firm* — Zhigang Ma

(57) ABSTRACT

A control system for elevators includes a capture apparatus, a processor and a storage apparatus. The capture apparatus captures images of each floor. The processor performs human detection on images of each floor to calculate the number of waiting passengers of each floor. The processor further calculates waiting time of each floor. The processor calculates weight of each floor based on the number of the waiting passengers and waiting time, and controls the elevator to the floor with maximum weight.

16 Claims, 7 Drawing Sheets

400

| Floor (s) | Waiting passengers | Waiting time (S) | ... |
|---|---|---|---|
| 1F | 0 | 0 | ... |
| 2F | 1 | 10 | ... |
| ⋮ | ⋮ | ⋮ | ⋮ |
| 8F | 2 | 35 | ... |

FIG. 3

402

| State Types | Basic weight | Unit | Each unit per Weight | Description |
|---|---|---|---|---|
| Waiting Passenger | 1 | 1 Person | 2 | The weight of the floor gains 2 by adding each person |
| Waiting time | 1 | 10 Seconds | 3 | The weight of the floor gains 3 by adding each 10s of waiting time |
| Floor prior | 1 | 1 Floor | 1.5 | The weight of the floor gains 1.5 by adding each floor |
| Ignore time | 1 | 1 Time | 2.5 | The weight of the floor gains 2.5 by ignoring each time |
| ⋮ | ⋮ | ⋮ | ⋮ | ⋮ |

FIG. 4

CONTROL SYSTEM AND METHOD FOR ELEVATOR

CROSS-REFERENCE TO RELATED APPLICATIONS

This application claims priority to Taiwanese Patent Application No. 102125641 filed on Jul. 17, 2013 in the Taiwan Intellectual Property Office, the contents of which are incorporated by reference herein.

FIELD

The subject matter herein generally relates to a control system and a method for elevators.

BACKGROUND

An elevator is a type of transport equipment that efficiently moves people or goods between floors. The routine of the elevator usually does not change, for the elevator can generally only run in one direction, such as down or up, to get to a destination floor. The direction that the elevator generally cannot be changed until after arrival at the destination floor.

BRIEF DESCRIPTION OF THE DRAWINGS

Implementations of the present technology will now be described, by way of example only, with reference to the attached figures.

FIG. 3 is a block diagram of a calculating table of the control system of the present disclosure.

FIG. 4 is a block diagram of a weight table of the control system of the present disclosure.

DETAILED DESCRIPTION

Figure 1:
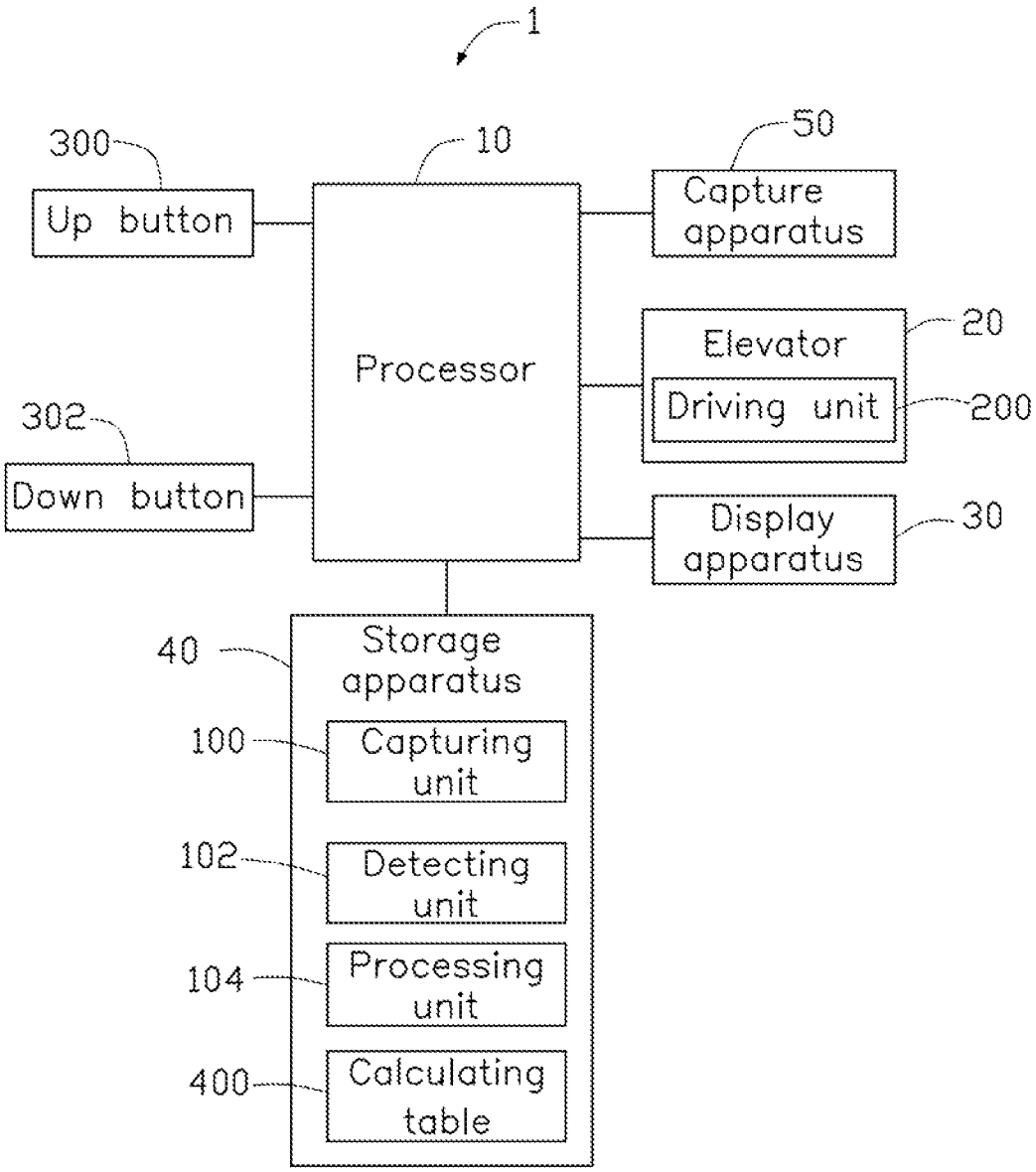
FIG. 1 is a block diagram of a control system for elevators of the present disclosure, wherein the control system comprises a display apparatus, a capture apparatus, a processor, and a storage apparatus.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The present disclosure is described in relation to a control system for elevators that can be controlled based on weight of each floor.

FIG. 1 illustrates a control system 1 for an elevator 20 of the present disclosure. The control system 1 can comprise a display apparatus 30, an up button 300, a down button 302, a capture apparatus 50, a storage apparatus 40, and a processor 10 coupled to the display apparatus 30, the capture apparatus 50, the storage apparatus 40, and the up and down buttons 300 and 302. In the embodiment, the elevator 20 can comprise a driving unit 200 that can control the elevator 20 to stop at each floor of a building. The display apparatus 30, the up and down buttons 300 and 302, and the capture apparatus 50 can be arranged at each floor.

The storage apparatus 40 stores a plurality of programs to be executed by the processor 10 to perform certain functions. The storage apparatus 40 can comprise a capturing unit 100, a detecting unit 102, and a processing unit 104.

Figure 2:
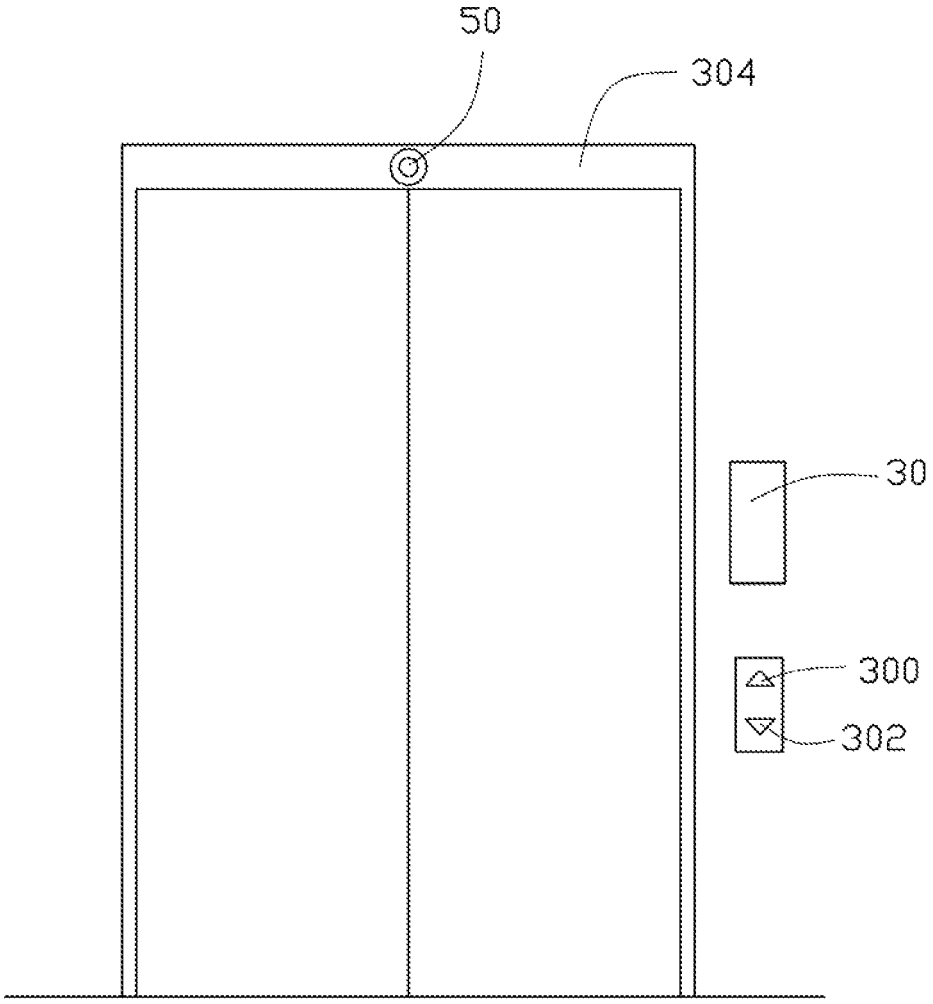
FIG. 2 is a plan view of an arrangement of the capture apparatus and the display apparatus of FIG. 1.

FIG. 2 illustrates that the capture apparatus 50 is arranged above a door 304 of each floor. The up and down buttons 300 and 302 are arranged at a left side of the door 304.

The capture unit 100 can capture images of each floor through the capture apparatus 50. In the embodiment, the capture apparatus 50 is a camera.

The detecting unit 102 can perform human detection on the images of each floor to detect whether at least one passenger is waiting at a corresponding floor.

FIG. 3 illustrates that a calculating table 400 is stored in the storage apparatus 40. The processing unit 104 can calculate the count of passengers (waiting passengers) waiting for the elevator 20 of each floor and a corresponding waiting time, and record the number of passengers and corresponding waiting time in the calculating table 400. In the embodiment, the waiting time begins to be counted when a first passenger appears at the corresponding floor. For example, the number of waiting passengers of a first floor is zero, and the waiting time at the first floor is zero seconds. The number of the waiting passengers of a second floor is one, and the waiting time at the second floor is ten seconds. The number of the waiting passengers of an eighth floor is two, and the waiting time at the eighth floor is thirty-five seconds.

FIG. 4 illustrates a weight table 402. In the embodiment, the processing unit 104 can calculate weight of each floor, to control the operation of the elevator 20 through the driving unit 200.

In the embodiment, the weight of the passenger at each floor can gain two by adding each one passenger, and gain three by adding each ten seconds waiting time. In other embodiments, the weight of the passengers at each floor can be changed according to the total number of the waiting passengers. For example, the weight of the passengers at corresponding floor can gain two by adding each waiting passenger when the total number of the waiting passengers are within five people. The weight of the passengers at corresponding floor may increase three by adding each waiting passenger when the total number of the waiting passengers is between five and ten people.

In the embodiment, the processing unit 104 can control the operation of the elevator 20 according to the sequence of the up and down buttons 300 and 302. For example, when two waiting passengers are at the fourth floor, if the up button 300 is called before the down button 302, the processing unit 104 then determines that the two waiting passengers may go to up to higher floors.

Figure 5:
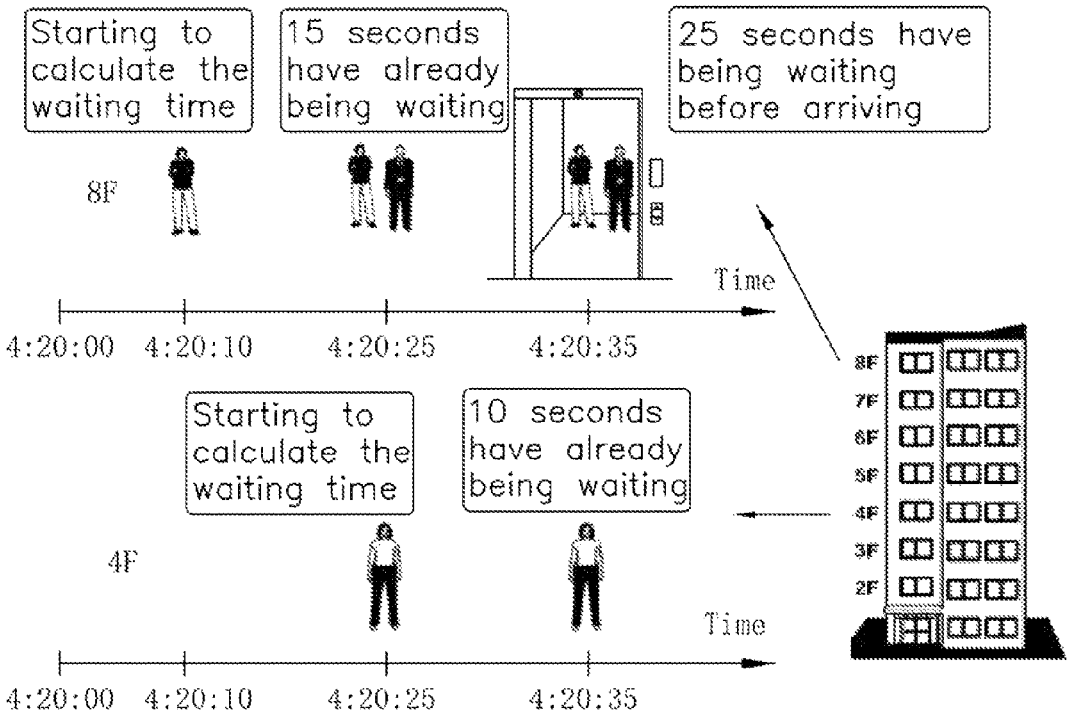
FIG. 5 is a diagrammatic view of a using state of the control system of the present disclosure.

FIG. 5 illustrates a using state of the control system 1 of the present disclosure. At the time 4:20:00, the processing unit 104 can determine that no passenger is waiting at the fourth and eighth floors. Hence, the waiting time of the fourth and eighth floors is zero seconds, and the number of waiting passenger at the fourth and eighth floors is zero. At the time 4:20:10, the processing unit 104 can determine that one waiting passenger is at the eighth floor. Accordingly, the number of waiting passengers at the eighth floor is one. At the same time, the waiting time of the eighth floor is calculated synchronously when the first person is at the eighth floor. By the time 4:20:25, a second person is at the eighth floor, the processing unit 104 then records that the number of waiting passengers at the eighth floor is two. At the same time, a first person appears at the fourth floor, the processing unit 104 can record that the number of waiting passengers at the fourth floor is one, and record that the waiting time of the fourth floor is zero seconds. Accordingly, the weight of the passengers at the eighth floor F8 is 8.5, that is F8=(2*2+1.5*3)=8.5, and the weight of the passengers at the fourth floor F4 is two, that is F4=(1*2)=2. And the weights of the passengers of other floors are zero. Accordingly, the processing unit 104 can control the elevator 20 to run to the maximum weight floor (the eighth floor) with the maximum weight, directly. For instance, the elevator 20 arrives at the eighth floor at 4:20:35, and then the processing unit 104 can set the number of waiting passengers at the eighth floor with zero, and the waiting time of the eighth floor with zero seconds. At the same time, when the elevator 20 arrives the eighth floor at 40:20:35, the waiting time of the fourth floor is ten seconds.

In other embodiments, the weight table 402 can further comprise other modes, such as floor prior mode and ignore ride mode. In the floor prior mode, the weight of the passengers at corresponding floor can increase 1.5 by adding each floor. In the ignore ride mode, the weight of the passengers at corresponding floor can increase 2.5 when the floor is ignored each time.

In other embodiments, at the time 4:20:25, if the elevator 20 is at the second floor, and the down button 302 of the fourth floor is called by the passenger who may go down to the second floor (downward). In the meantime, according to the waiting passenger, waiting time, and floor prior mode, the weight of passengers at the eighth floor F8 increases 19.5, that is F8=(2*2+1.5*3+8*1.5)=19.5, and the weight of the passengers at the fourth floor F4 increases 8, that is F4=(1*2+4*1.5)=8. Hence, the weight of the passengers at the eighth floor is greater than the weight of the passengers at the fourth floor. While the down button 302 of the fourth floor is called, and the elevator 20 is needed to run to the eighth floor from the current floor (the second floor). Hence, the direction that the passenger chooses at the second floor (downward) is opposite with the direction that the elevator is intended to operate (upward). The elevator 20 is controlled to run to the eighth floor directly, and the fourth floor is ignored at this time.

In other embodiments, according to the weight of the passengers, floor prior mode, and the ignore ride mode, when the elevator 20 runs to the eighth floor at 4:20:35, the weight of the passengers at the eighth floor F8 is 0, and the weight of the passengers at the fourth floor F4 increases 13.5, that is F4=(1*2+4*1.5+1*2.5+1*3)=13.5.

In other embodiments, at time 4:20:25, if the elevator 20 is at the second floor, and the up button 300 of the fourth floor is called by the passenger, while the weight of the passenger at the eighth floor is greater than the fourth floor, the processing unit 104 controls the elevator 20 to the eighth floor from the current floor, that is upward. At this time, the direction of the elevator 20 is the same as the direction chosen by the passenger at the fourth floor, the elevator 20 can stop at the fourth floor, and then go to the eighth floor.

In other embodiments, the processing unit 104 can further determine whether pre-loading passengers are greater than the maximum-loading passengers that the elevator 20 can effort, before the elevator running to the maximum weight floor from the current floor (such as the second floor). When the pre-loading passengers are greater than the maximum-loading passengers, the processing unit 104 can controls the elevator 20 run to the maximum weight floor directly, with no stop at internal floors. For example, if two passengers are at the eighth floor, and the up button 300 of the eighth floor is called, and one passenger is at the fourth floor, and the up button 300 of the fourth floor is called. While, the maximum-loading passengers of the elevator 20 is two. Before the elevator 20 goes to the fourth floor, the processing unit 104 can determine that the pre-loading passengers are three (one passenger at the fourth floor, and two passengers at the eighth floor). In order to prevent the elevator 20 from being override, the processing unit 104 can control the elevator 20 to go to the eighth floor directly from the second floor, with no stop at the fourth floor.

The processing unit 104 can further display the operation status of the elevator 20 on the display apparatus 30.

Figure 6:
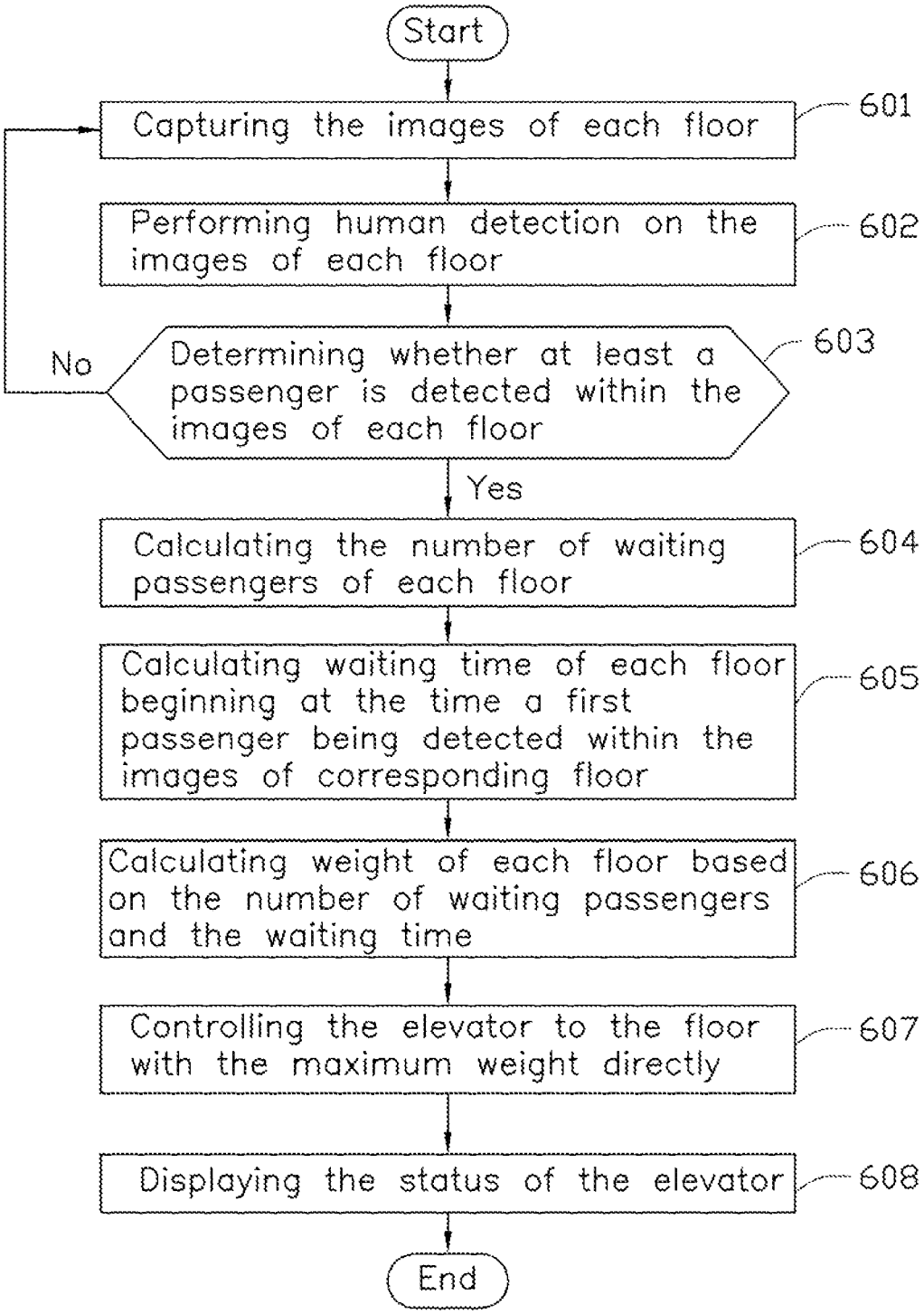
FIG. 6 is a flow chart of a first embodiment of a control method for elevators of the present disclosure.

FIG. 6 illustrates a flow chart of a first embodiment of a control method of the elevator 20 of the present disclosure.

At block 601, the capturing unit can capture images of each floor through corresponding capture apparatus.

At block 602, the detecting unit can perform human detection on the images of each floor.

At block 603, the processing unit determines whether at least one passenger is detected within the images of each floor. If at least one passenger is detected within the images of one floor, block 604 is implemented; if no passengers are detected within the images, block 601 is repeated.

At block 604, the processing unit can calculate the number of the waiting passengers of each floor.

At block 605, the processing unit can calculate the waiting time of each floor beginning at the time a first passenger being detected within the images of corresponding floor.

At block 606, the processing unit can calculate the weight of the passengers at each floor based on the number of waiting passengers and the waiting time.

At block 607, the processing unit can control the elevator to the floor with the maximum weight directly.

At block 608, the display apparatus can display the operation status of the elevator.

Figure 7:
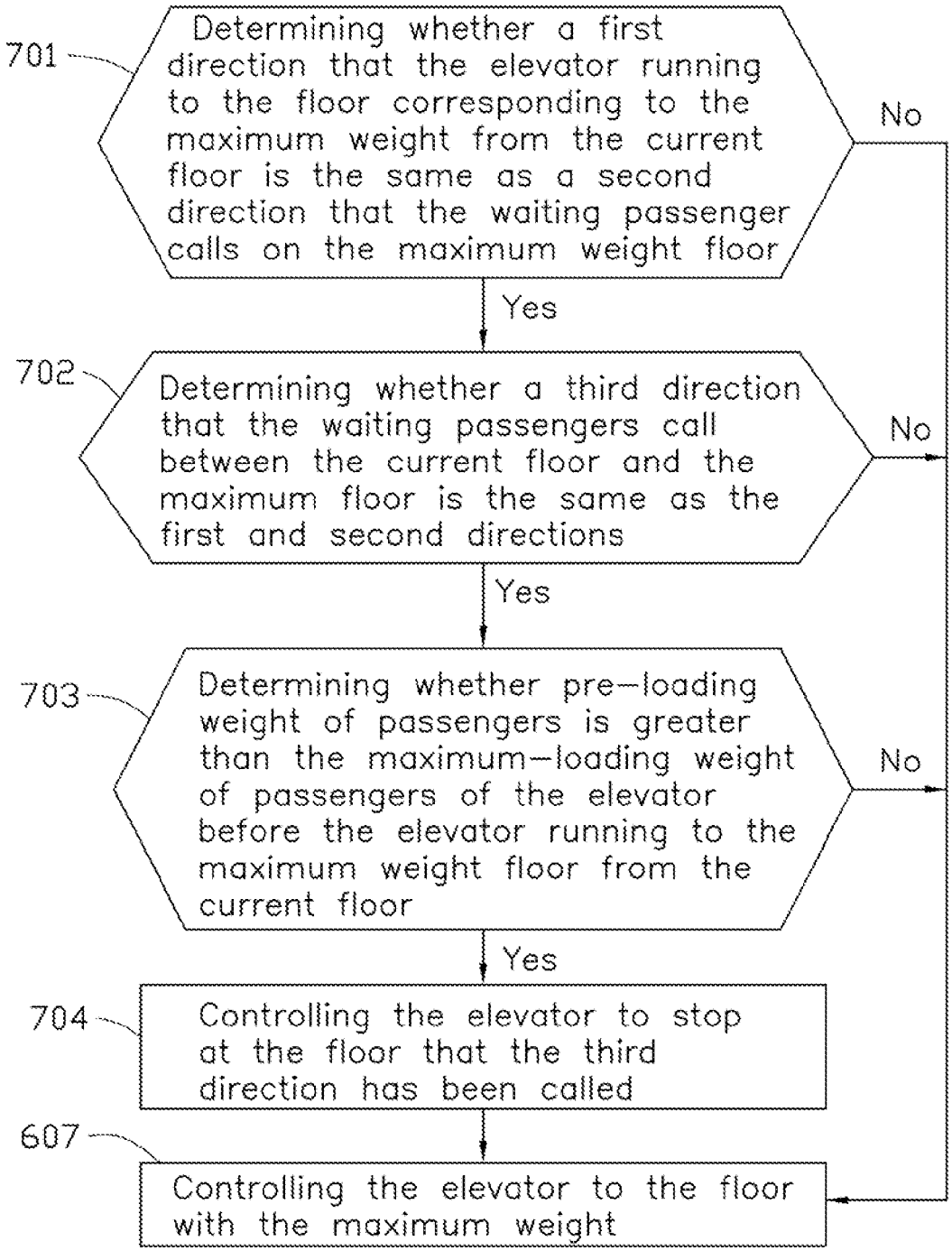
FIG. 7 is a flow chart of a second embodiment of the control method of the present discourse.

FIG. 7 illustrates that a second embodiment of the control method of the present disclosure. The second embodiment of the control method can further comprise external blocks between blocks 606 and 607 as comparing to the first embodiment of the control method.

At block 701, the processing unit 104 can determine whether a first direction that the elevator running to the floor corresponding to the maximum weight from the current floor is the same as a second direction that the waiting passenger calls on the maximum weight floor. If the first direction is the same as the second direction, block 702 is implemented. If the first direction is different from the second direction, block 607 is implemented.

At block 702, the processing unit 104 can determine whether a third direction that the waiting passengers call between the current floor and the maximum floor is the same as the first and second directions. If the third direction is the same as the first and second directions, block 703 is implemented. If the third direction is different from the first and second directions, block 607 is implemented.

At block 703, the processing unit 104 can determine whether pre-loading weight of passengers is greater than the maximum-loading weight of passengers of the elevator before the elevator running to the maximum weight floor from the current floor. If the pre-loading passengers are greater than the maximum-loading passengers, block 704 is implemented. If the pre-loading passengers are less than the maximum-loading passengers, block 607 is implemented. In the embodiment, the pre-loading passengers are the total number of the passengers that are in the elevator and the passengers, between the current floor and the floor corresponding to the maximum weight, choosing the third direction being the same as the first direction.

At block 704, the processing unit 104 can control the elevator 20 to stop at the floors that the passengers call in the third direction between the current floor and the maximum weight floor.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

The invention claimed is:

1. A control system for an elevator, comprising:
a capture apparatus capturing images of each floor;
a processor coupled to the capture apparatus; and
a storage apparatus coupled to the processor and storing a plurality of programs to be executed by the processor to perform certain functions, the storage apparatus comprising a plurality of units configured to be executed by the processor, the units comprising:
a detecting unit configured to perform human detection on images of each floor to determine whether the images of each floor contains passengers; and
a processing unit configured to calculate the number of passengers of each floor, in response to at least one passenger detecting within the images of corresponding floor, and calculating waiting time of each floor beginning at the time a first passenger being detected within the images of corresponding floor;
wherein the processing unit is configured to calculate weight of the passengers at each floor based on the number of passengers and waiting time and control the elevator to the floor corresponding to the maximum weight.

2. The control system of claim 1, wherein the processing unit determines whether a first direction that the elevator running to the floor corresponding to the maximum weight from the current floor is the same as a second direction that the waiting passenger calls on the maximum weight floor; when the first direction is different from the second direction, the processing unit controls the elevator to the maximum weight floor.

3. The control system of claim 2, wherein when the first and second directions are the same, the processing unit determines whether a third direction that the waiting passengers call between the current floor and the maximum floor is the same as the first and second directions; when the third direct is the same as the first direction, the processing unit controls the elevator to stop the floors that the waiting passengers call in the third direction.

4. The control system of claim 1, wherein the processing unit calculates the weight of each floor based on a floor prior mode, the weight of the floor gains a first predetermined value by adding each floor.

5. The control system of claim 2, wherein the processing unit calculates the weight of each floor based on an ignoring ride mode, the weight of the floor gains a second predetermined value by ignoring each time.

6. The control system of claim 5, wherein the processing unit determines whether a first direction that the elevator running to the floor corresponding to the maximum weight from the current floor is the same as a second direction that the waiting passenger calls on the maximum weight floor; when the first direction is different from the second direction, the processing unit controls the elevator to the maximum weight floor.

7. The control system of claim 6, wherein when the first and second directions are the same, the processing unit determines whether a third direction that the waiting passengers call between the current floor and the maximum floor is the same as the first and second directions; when the third direct is the same as the first direction, the processing unit controls the elevator to stop the floors that the waiting passengers call in the third direction.

8. The control system of claim 7, wherein the processing unit determines whether pre-loading weight of passengers are greater than the maximum-loading weight of passengers of the elevator before the elevator running to the maximum weight floor from the current floor, the processing unit controls the elevator to the maximum weight floor in response to the pre-loading passengers greater than the maximum-loading passengers.

9. The control system of claim 8, wherein the processing unit controls the elevator to stop at the floor of the third direction called by the waiting passengers, in response to the pre-loading weight of passengers less than the maximum-loading weight of passengers.

10. A control method of elevators, comprising:
capturing images of each floor;
performing human detection on images of each floor to determines whether the images of each floor contains passengers;
calculating the number of passengers of each floor, in response to at least one passenger detecting within the images of corresponding floor;
calculating waiting time of each floor beginning at the time a first passenger being detected within the images of corresponding floor;
calculating weight of each floor based on the number of passengers and waiting time; and
controlling the elevator to the floor corresponding to the maximum weight.

11. The control method of claim 10, further comprising:
determining whether a first direction that the elevator running to the floor corresponding to the maximum weight from the current floor is the same as a second direction that the waiting passenger calls on the maximum weight floor;
controlling the elevator to the maximum weight floor in response to the first direction being different from the second direction.

12. The control method of claim 11, further comprising:
determining whether a third direction that the waiting passengers call between the current floor and the maximum floor is the same as the first and second directions, in response to the first direction being the same as the second direction;

controlling the elevator to stop the floors that the waiting passengers call in the third direction, in response to the third direct is the same as the first direction.

13. The control method of claim 12, further comprising:

determining whether pre-loading weight of passengers are greater than the maximum-loading weight of passengers of the elevator before the elevator running to the maximum weight floor from the current floor;

controlling the elevator to the floor corresponding to the maximum weight in response to the pre-loading weight of passengers greater than the maximum-loading weight of passengers.

14. The control system of claim 12, further comprising:

controlling the elevator to stop at the floor of the third direction called by the waiting passengers, in response to the pre-loading weight of passengers less than the maximum-loading weight of passengers.

15. The control method of claim 14, further comprising:

calculating the weight of each floor based on a floor prior mode, wherein the weight of the floor gains a first predetermined value by adding each floor.

16. The control method of claim 15, further comprising:

calculating the weight of each floor based on an ignoring ride mode, wherein the weight of the floor gains a second predetermined value by ignoring each time.

* * * * *